United States Patent [19]

Modrovich

[11] Patent Number: 4,765,106

[45] Date of Patent: Aug. 23, 1988

[54] CONSCREED BRACKET

[76] Inventor: Nandor I. Modrovich, 2466 E. Chevy Chase Dr., Glendale, Calif. 91206

[21] Appl. No.: 727,245

[22] Filed: Apr. 25, 1985

[51] Int. Cl.[4] ..... E04F 13/04

[52] U.S. Cl. ..... 52/365; 52/678; 248/70; 248/74.1

[58] Field of Search ..... 248/49, 65, 67.5, 67.7, 248/70, 74.1; 425/458; 404/70; 249/205; 52/365, 678

[56] References Cited

U.S. PATENT DOCUMENTS

| | | | |
|---|---|---|---|
| 1,596,039 | 8/1926 | Whittaker | 52/365 |
| 2,912,197 | 11/1959 | Hudson | 248/49 |
| 3,006,115 | 10/1961 | Hillberg | 52/365 |
| 3,115,726 | 12/1963 | Sayles | 52/365 X |
| 3,333,380 | 8/1967 | Wolf | 52/365 |
| 3,390,500 | 7/1968 | Schumak | 52/365 |
| 3,579,938 | 5/1971 | Hanson | 52/365 |
| 4,158,937 | 6/1979 | Henry | 52/365 |

OTHER PUBLICATIONS

Interbuild, Apr. 1963, p. 42.

*Primary Examiner*—David L. Talbott

*Attorney, Agent, or Firm*—Christie, Parker & Hale

[57] ABSTRACT

There is provided a conscreed bracket which comprises a bracket member, a conduit for receiving a rail to be retained in said conduit secured to said bracket, thread means to be receive a threaded bolt secured to said bracket on opposed sides of the conduit, and bolt means threaded into thread means to enable raising or lowering of the conduit relative to a substrate.

10 Claims, 4 Drawing Sheets

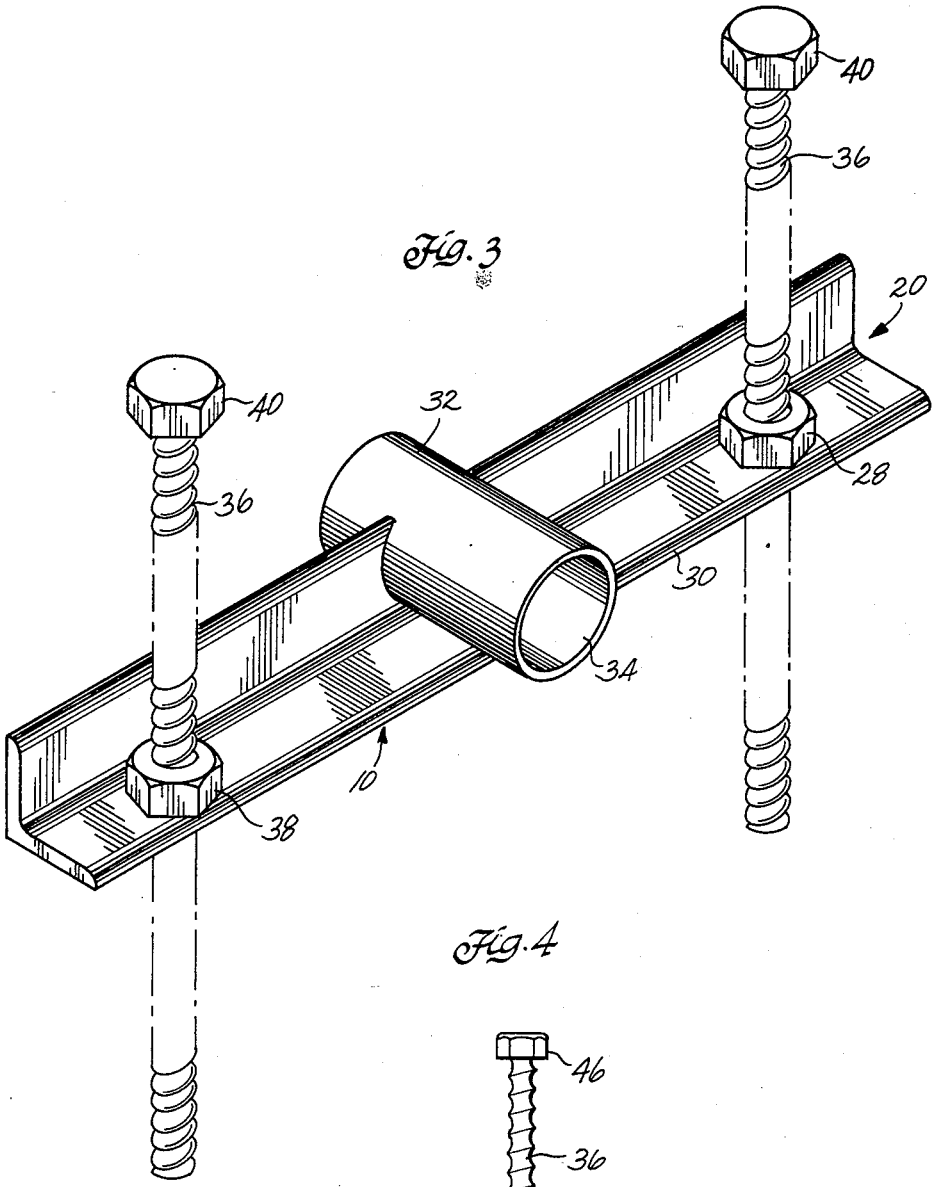
Fig. 3
Fig. 4
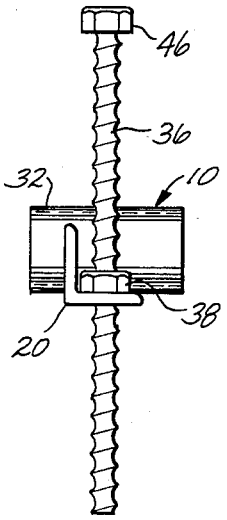

CONSCREED BRACKET

BACKGROUND OF THE INVENTION

"Conscreed" is an art term for brackets used in combination with spanners or rails, normally pipes, used for smoothing concrete to a defined plane after the concrete has been poured onto a substrate, in particular, a metal deck. In the operation, rails positioned by two or more conscreeds and spaced in parallel, form a zone which serves as a guide over which one strikes poured concrete to the predetermined plane.

As shown in FIG. 1, a typical application is in the construction of the floors of multi-story building where the floor base is a corregated metal deck on which conscreed-supported pipe rails serve as a guide by which to determine the plane of the poured concrete when a strike is made over the rails which define a predetermined plane. As illustrated, the plane itself is determined by using conscreeds 10 in cooperation with rail (pipe) 12 to position the rail or pipe at a predetermined level from the surface of substrate 14. The conscreed currently in use is depicted in FIG. 2. To adjust the elevation of the pipe, loop 16, formed by brackets 18 and 20, requires loosening nuts 20, driving bolts 22 inward or outward of nuts 24 to raise or lower the pipe, then retightening nuts 20 to lock the conscreened rail in position prior to pouring of the concrete.

The system shown in FIG. 2 requires considerable effort to adjust and is overly time-consuming.

The present invention is directed to a more simplified bracket which is easier to adjust, reducing the time required to create the plane at which the concrete will be laid at a predetermined level.

SUMMARY OF THE INVENTION

The conscreed bracket of the instant invention comprises a bracket providing a substantially rail-enclosing conduit, on opposed sides of which are threaded receptacles for adjusting bolts which enable a change in elevation of the rail-enclosing conduit by simply being driven inward or outward of threaded means, the loosening or tightening of nuts not being required. Of course, locking nuts may be used, if desired.

The preferred rail is a pipe, and it is preferred that the conduit surround the pipe to prevent raising of the pipe from the conduit by upward loads applied by poured concrete. To this end, the conduit preferably encloses the pipe, but is adapted to enable the pipe to freely slide into a conduit, preferably of circular cross-section.

BRIEF DESCRIPTION OF THE DRAWINGS

FIG. 3 is a perspective view of the improved conscreed bracket of the instant invention.

FIG. 4 is a side view of the improved conscreed bracket of the instant invention.

DETAILED DESCRIPTION

Figure 1:
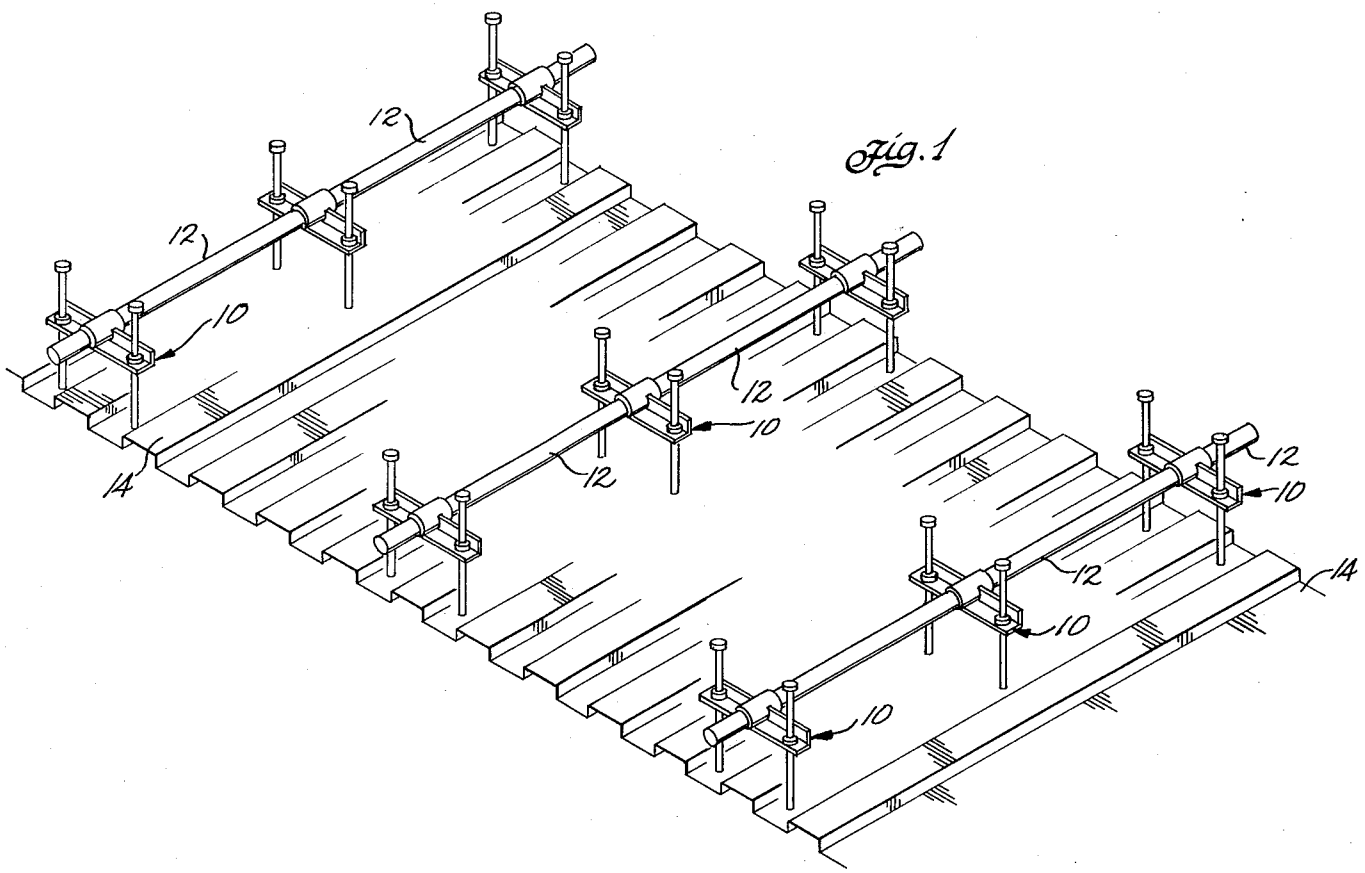
FIG. 1 illustrates the conscreed system of laying concrete.

With reference now to FIGS. 1, 3, 4, 5 and 6, the conscreed 10 of the instant invention comprises a bracket member 30 to which there is secured a rail-embracing conduit 32 providing an opening 34 adapted to receive a rail, which may be a rectangular channel, a right-angle channel, a circular opening (as depicted) for receiving a pipe, or the like. While conduit 32 is shown to enclose a rail, e.g., pipe, all that is necessary is that it surround the rail sufficiently to prevent lifting of the rail from the bracket caused by the forces applied by poured concrete. In addition, the conduits may be provided with a tightening bolt 33 to form a compressive load on a rail inserted in the provided opening, which is of smaller dimension than opening 34, such as a pipe of smaller diameter. On opposed sides of conduit 32 are means, shown as bolts 36, secured to bracket means 30 by threaded means 38, to accept adjusting bolts 36. With reference to FIG. 1, the level of rail 12 above substrate 14, onto which concrete is poured, is determined by the degree to which bolts 36 is driven into threaded means 38. Adjustment is made simply by turning of head 40, normally by use of a wrench.

Figure 2:
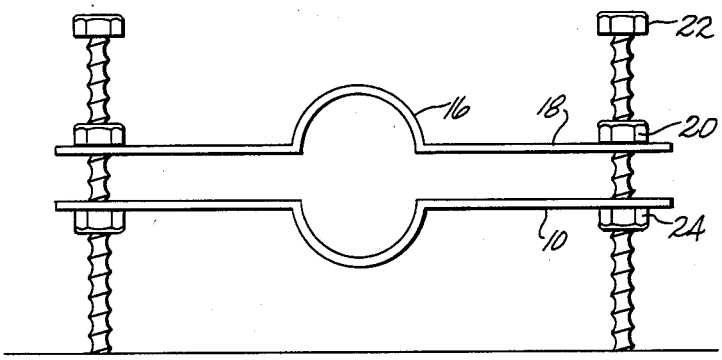
Fig. 2 PRIOR ART
FIG. 2 is an end view of the prior-art conscreed.
Figure 5:
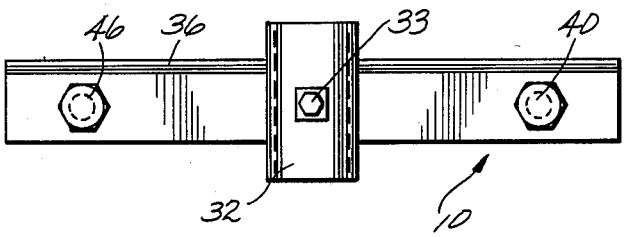
FIG. 5 is a top view of the improved conscreed bracket of the instant invention.
Figure 6:
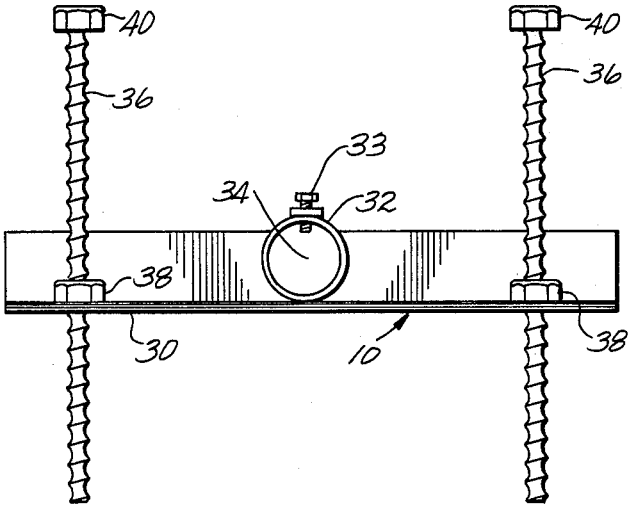
FIG. 6 is a frontal view of the improved conscreed bracket of the instant invention.

Since the only point of adjustment need be by driving bolts 36 into threaded means 38, there are no nuts to be loosened and/or retightened to secure the guide rail in location. (See FIG. 2.)

In the presently preferred embodiment, as depicted, the conduit, or sleeve 32, is of circular cross-section, and bolts 36 and receptive threaded means 38, shown as a nut secured to bracket means 30, are selected as coil threads for ease of cleaning and washing away of residual concrete after the pouring operation.

As will be appreciated, conduit 34 may be of any cross-sectional configuration, e.g., square, triangular, or round (as shown), and the like, and may be adapted to receive rails of varying size. In the preferred embodiment, however, the enclosed circular opening is adapted to receive a pipe of from about 1.5 inches in diameter, to enable use of the improved bracket of the instant invention with conventional conscreed pipes.

As indicated, the arrangement of bolt 36 and nut 38 preferably consists of a coil-thread combination for ease of cleaning the adjusting bolts relative to fixed nuts 38, but any type of thread arrangement can be employed. Adjusting heads 40 at the top of bolts 36 may be replaced by simply cutting champhers on the upper surface of the bolts to enable the driving of the bolts inward and outward of the threaded nuts 38.

With reference again to FIG. 1, in operation a plurality of conscreeds 10 are normally used along the length of rail 12 onto parallel-spaced rails 12 by sliding the conscreed rail 12 through the conduits of conscreeds 10 and then, with the aid of a wrench, turning the adjusting bolts 30 clockwise or counter-clockwise to raise the elevation of the conscreed bracet to a predetermined elevation of the conscreed for enabling the pouring of the concrete and its leveling to a desired plane.

What is claimed is:

1. A conscreed bracket which comprises:

(a) a bracket member;

(b) a conduit secured to said bracket member for receiving in slidable embracing relation to a rail to be retained in said conduit and constrained by said conduit from upward movement out of said conduit;

(c) thread means to receive bolts secured to said bracket on opposed sides of the conduit; and (d) bolt means having a head end extenidng above the conduit threaded into thread means to enable, by rotation of the head end of the bolt means clockwise or counterclockwise, the raising or lowering of the conduit relative to a substrate.

2. A conscreed bracket as claimed in claim 1 in which said bracket member is substantially L-shaped having a vertically extending side extending upward from a horizontally extending side and in which the conduit is cylindrical for receiving and constraining a pipe rail from upward movement, said conduit being secured to and partially embraced by the vertically extending side of said bracket member.

3. A conscreed bracket as claimed in claim 2 in which the conduit includes a tightening bolt to provide a compressive load on a pipe rail engaged by the conduit.

4. A conscreed bracket as claimed in claim 1 in which the thread of the threaded bolt and means to secure said thread are of coil threads.

5. A conscreed bracket which comprises:

(a) a substantially L-shaped bracket member having a vertically extending side extending upward from a horizontally extending side;

(b) a conduit having an opening adapted to receive a rail extending along the horizontally extending side and through the vertically extending side and centrally secured to said bracket member for receiving in slidable embracing relation a rail to be retained in said conduit and prevented by said conduit from upward movement out of said conduit; and (c) coil threaded bolt means having a head end extending above the conduit threaded into coil threaded means provided by the horizontally extending side to enable, by rotation of the head end of the bolt means, clockwise or counterclockwise, the raising or lowering of the conduit relative to a substrate.

6. A conscreed bracket as claimed in claim 5 in which the conduit is cylindrical and adapted to secure a pipe rail.

7. A conscreed bracket as claimed in claim 6 in which the conduit extends above the vertically oriented side of said L-shaped bracket member.

8. A conscreed bracket as claimed in claim 7 in which the conduit includes a tightening bolt to provide a compressive load on a pipe rail engaged by the conduit.

9. A system for use in defining a plane for scoring concrete, which system comprises in combination:

(a) a plurality of conscreed brackets which comprises:

(i) a substantially L-shaped bracket member having a vertically extending side extending upward from a horizontally extending side;

(ii) a cylindrical conduit secured to said bracket member for receiving in slidable embracing relation a pipe rail to be retained in said conduit, said conduit extending along said horizontal extending and through said vertically extending side of said bracket member and adapted to constrain said pipe from upward movement out of said conduit;

(iii) coil threaded means to receive a coil threaded bolt secured to said bracket member on opposed sides of the conduit; and (iv) coil threaded bolt means having a head end extending above the conduit threaded into threaded means to enable, by rotation of the head end of the bolt means clockwise or counterclockwise, the raising or lowering of the conduit relative to a substrate; and (v) a pipe rail extending between said conscreed brackets below the head end and being contained by the conduit.

10. A conscreed bracket as claimed in claim 9 in which the conduit extends above the vertically extending side of said L-shaped bracket member.

* * * * *

UNITED STATES PATENT AND TRADEMARK OFFICE

CERTIFICATE OF CORRECTION

PATENT NO. : 4,765,106

DATED : August 23, 1988

INVENTOR(S) : Nandor I. Modrovich

It is certified that error appears in the above-identified patent and that said Letters Patent is hereby corrected as shown below:

In the Abstract

| | |
|---|---|
| Abstract, Line 4 | Change "receive" to -- received --. |

In the Specification

| | |
|---|---|
| Column 1, Line 14 | Change "building" to -- buildings --. |
| Column 2, Line 17 | Change "bolts" to -- bolt --. |
| Column 2, Line 52 | Change "counter-clockwise" to -- counterclockwise --. |
| Column 2, Line 53 | Change "bracet" to -- bracket --. |

In the Claims

| | |
|---|---|
| Column 2, Line 64 | After "receive" and before "bolts" insert -- threaded --. |
| Column 2, Line 66 | Before "above" change "extenidng" to -- extending --. |

UNITED STATES PATENT AND TRADEMARK OFFICE

CERTIFICATE OF CORRECTION

PATENT NO. : 4,765,106

DATED : August 23, 1988

INVENTOR(S) : Nandor I. Modrovich

It is certified that error appears in the above-identified patent and that said Letters Patent is hereby corrected as shown below:

Column 4, line 18 Before "and" insert -- side --.

Signed and Sealed this

Seventeenth Day of January, 1989

*Attest:*

DONALD J. QUIGG

*Attesting Officer* *Commissioner of Patents and Trademarks*